US010024520B2

(12) United States Patent
Nakatani et al.

(10) Patent No.: US 10,024,520 B2
(45) Date of Patent: Jul. 17, 2018

(54) ILLUMINATION DEVICE

(71) Applicants: TOYODA GOSEI CO., LTD., Kiyosu-shi, Aichi-ken (JP); ORIGIN ELECTRIC COMPANY, LIMITED, Saitama-shi, Saitama (JP)

(72) Inventors: Koji Nakatani, Aichi (JP); Yuichi Nishimura, Tokyo (JP); Ryuji Nakanishi, Tokyo (JP)

(73) Assignees: TOYODA GOSEI CO., LTD., Aichi-pref. (JP); ORIGIN ELECTRIC COMPANY, LIMITED, Saitama (JP)

( * ) Notice: Subject to any disclaimer, the term of this patent is extended or adjusted under 35 U.S.C. 154(b) by 170 days.

(21) Appl. No.: 14/533,363

(22) Filed: Nov. 5, 2014

(65) Prior Publication Data

US 2015/0131286 A1 May 14, 2015

(30) Foreign Application Priority Data

Nov. 8, 2013 (JP) ..... 2013-231649

(51) Int. Cl.
*F21V 9/16* (2006.01)
*F21V 9/30* (2018.01)
(Continued)

(52) U.S. Cl.
CPC ..... *F21V 9/30* (2018.02); *F21K 9/64* (2016.08); *F21V 9/16* (2013.01); *F21Y 2115/10* (2016.08)

(58) Field of Classification Search
CPC ..... F21V 9/16; F21K 9/56; F21K 9/64; F21K 9/30
(Continued)

(56) References Cited

U.S. PATENT DOCUMENTS 7,985,008 B2 7/2011 Kaisser et al.
8,506,101 B2 * 8/2013 Mathers ..... H01H 9/182 200/311
(Continued)

FOREIGN PATENT DOCUMENTS

JP 06-019411 A 1/1994
JP 4469361 B2 3/2010
(Continued)

OTHER PUBLICATIONS

EMD Performance Materials Iriodin.*
(Continued)

*Primary Examiner* — Elmito Breval
*Assistant Examiner* — Naomi M Wolford
(74) *Attorney, Agent, or Firm* — Posz Law Group, PLC

(57) ABSTRACT

Provided is an illumination device containing a light source configured to emit an excitation light, a phosphor layer containing a phosphor and configured to allow the excitation light of the light source to be transmitted and emitted therethrough, and a coating film formed by applying a paint containing a pigment and mica and configured to allow the emitted light of the phosphor layer to be transmitted and emitted therethrough, in which the coating film has a light transmission spectrum having a peak wavelength located between a peak wavelength of an emission spectrum of the light source and a peak wavelength of an emission spectrum of the phosphor layer.

15 Claims, 4 Drawing Sheets

(51) Int. Cl.
*F21K 9/64* (2016.01)
*F21Y 115/10* (2016.01)

(58) Field of Classification Search
USPC ..... 362/260
See application file for complete search history.

(56) References Cited

U.S. PATENT DOCUMENTS

| | | | | |
|---|---|---|---|---|
| 8,545,721 | B2 * | 10/2013 | Shim | C09D 7/1275 252/301.36 |
| 2009/0052180 | A1 * | 2/2009 | Baillie | G09F 13/08 362/253 |
| 2012/0104935 | A1 * | 5/2012 | Haase | H01L 33/504 313/499 |
| 2013/0270591 | A1 * | 10/2013 | de Brouwer | H01L 23/293 257/98 |
| 2013/0271042 | A1 * | 10/2013 | Kim | H01L 33/50 315/309 |

FOREIGN PATENT DOCUMENTS

| | | |
|---|---|---|
| JP | 2011-119248 A | 6/2011 |
| JP | 2011-139251 A | 7/2012 |

OTHER PUBLICATIONS

EMD Performance Materials Iriodin, Merck KGaA, Darmstadt, Germany, Last Update Oct. 19, 2015, http://www.emd-performance-materials.com/en/plastics/pinting_and_plastics_iriodin/printing_and_plastics_iriodin.html.*

EMD Performance Materials Iriodin, Web Archive Snapshot dated Apr. 16, 2012, http://web.archive.org/web/20120416082403/http://www.emd-performance-materials.com/en/plastics/pinting_and_plastics_iriodin/printing_and_plastics_iriodin.html.*

Office Action dated Feb. 17, 2016 issued in corresponding JP patent application No. 2013-231649 (and English translation).

* cited by examiner (A)

(B)

ILLUMINATION DEVICE

TECHNICAL FIELD

The present invention relates to an illumination device and, more particularly, to an illumination device including an excitation light source and a phosphor layer.

BACKGROUND ART

Patent Document 1 discloses a light emitting device including a light source and a coloration variable member which is arranged between the light source and a viewing point and has characteristics of preferentially developing light permeability for light emitted from the light source in the turn-on time of the light source but preferentially developing light reflectivity for external light in the turn-off time of the light source, in which the coloration variable member is formed by applying a coloration variable paint containing a pearl pigment such as mica on at least one surface of a light transmissive substrate which is transparent or translucent.

Patent Document 2 discloses a plastic component including a visible part containing a transparent or translucent matrix and a light source provided below the surface of the visible part, in which the visible part acts as opaque for daylight and acts as transparent or translucent for light emitted from the light source, and in which the visible part contains a pigment having an admixed effect, such as mineral mica.

Patent Document 1: JP-A-H06-19411

Patent Document 2: Japanese Patent No. 4469361

SUMMARY OF THE INVENTION

Conventionally, it has been known a technique (ornament with illumination) that makes up illumination by mounting an illumination device to an ornament of a vehicle.

In the ornament with illumination, it is conceivable to improve the design quality by fixedly-mounting a decorative member such as a sheet material or a lens, made of synthetic resin, on the front side of a light source, so that when the light source is turned on, the light is brightly emitted with high brightness through the decorative member, and when the light source is turned off, the decorative member is allowed to be glittered in a metallic tone (a metallic feeling is provided to an appearance).

In order to allow the decorative member to be glittered in a metallic tone when the light source is turned off, it is conceivable to form a metallic layer on the surface of the decorative member by plating or depositing, or to perform a metallic coating on the surface of the decorative member, for example.

Meanwhile, when characters, signs or the like for decoration of the ornament is formed on the surface of the decorative member, it is required to form a metallic layer in conformity with the shape of the characters or signs. However, it is difficult to form the metallic layer only on a predetermined portion of the surface of the decorative member.

Further, it is difficult to form the metallic layer on the curved surface when the surface of the decorative member is a curved surface with large undulation.

In order to allow the light emitted from a light source to be emitted with high brightness through the decorative member when the light source is turned on, it is preferable to increase the light transmittance by reducing a layer thickness of the metallic layer.

Further, in order to allow the decorative member to be glittered in a metallic tone when the light source is turned off, it is preferable to lower the light transmittance by increasing the layer thickness of the metallic layer.

That is, in the turn-on time and the turn-off time of the light source, there is a trade-off relationship between the light transmittance and the layer thickness of the metallic layer. Accordingly, it is difficult to improve the design quality in both the turn-on time and the turn-off time of the light source.

Further, the metallic coating contains metallic flakes as a pigment. However, the metallic flakes have characteristics of high light reflectivity and low light permeability.

In order to allow the light emitted from a light source to be emitted with high brightness through the decorative member when the light source is turned on, it is preferable to increase the light transmittance by reducing the content of the metallic flakes.

Further, in order to allow the decorative member to be glittered in a metallic tone when the light source is turned off, it is preferable to lower the light transmittance by increasing the content of the metallic flakes.

That is, in the turn-on time and the turn-off time of the light source, there is a trade-off relationship between the light transmittance of the metallic coating and the content of the metallic flakes. Accordingly, it is difficult to improve the design quality in both the turn-on time and the turn-off time of the light source.

Although the invention disclosed in Patent Document 1 uses a pearl pigment such as mica and the invention disclosed in Patent Document 2 uses a pigment having an admixed effect, such as mineral mica, both of the inventions utilize interference of light by the pigment such as mica.

Therefore, when the decorative member is manufactured in accordance with the coloration variable member disclosed in Patent Document 1 or with the plastic component disclosed in Patent Document 2, the light from the light source is less likely to be emitted to the outside through the decorative member due to the interference by the pigment. Accordingly, the light transmittance of the decorative member is lowered when the light source is turned on. As a result, it is difficult to allow the light from the light source to be emitted with high brightness through the decorative member when the light source is turned on.

The present invention has been made to solve the above-described problems and an object thereof is to provide an illumination device capable of improving the design quality in both the turn-on time and the turn-off time of the light source.

The present inventors have made intensively studies in order to solve the problems and reached each aspect of the present invention as described below.

<First Aspect>

The first aspect of the present invention is an illumination device containing:

a light source configured to emit an excitation light;

a phosphor layer containing a phosphor and configured to allow the excitation light of the light source to be transmitted and emitted therethrough; and a coating film formed by applying a paint containing a pigment and a mica and configured to allow the emitted light of the phosphor layer to be transmitted and emitted therethrough, in which the coating film has a light transmission spectrum having a peak wavelength located between a peak wavelength of an emission spectrum of the light source and a peak wavelength of an emission spectrum of the phosphor layer.

In the first aspect, a primary light is an excitation light of the light source and a portion of the primary light excites the phosphor contained in the phosphor layer to generate a wavelength-converted secondary light (fluorescence). The primary light and the secondary light are mixed, so that the mixed light is emitted as the emitted light from the phosphor layer.

Since the coating film contains mica, the coating film has characteristics of preferentially developing light permeability for excitation light in the turn-on time (emitting time) of the light source and preferentially developing light reflectivity for external light in the turn-off time (non-emitting time) of the light source.

Further, the coating film has a light transmission spectrum having a peak wavelength located between a peak wavelength of the emission spectrum of the light source and a peak wavelength of the emission spectrum of the phosphor layer.

Therefore, when the light source is turned on, the emitted light (excitation light plus fluorescence) is absorbed and scattered by the pigment contained in the coating film and also transmitted through the mica, so that the emitted light is uniformly diffused. Accordingly, it is possible not only to allow the coating film to be glittered with high brightness but also to reduce the emission unevenness of the coating film.

Further, when the light source is turned off, it is possible to allow the coating film to be glittered in a metallic tone (to provide a metallic feeling to an appearance) by increasing the brilliance of the coating film.

As a result, according to the first aspect, it is possible to provide the illumination device capable of improving the design quality in both the turn-on time and the turn-off time of the light source.

<Second Aspect>

The second aspect of the present invention is the illumination device according to the first aspect, in which the light transmission spectrum of the coating film has strength smoothly varying centering around the peak wavelength.

In the second aspect, it is possible to more reliably achieve the function and effect of the first aspect.

Meanwhile, the smooth varying in the strength in the light transmission spectrum of the coating film means that a full width at half maximum (FWHM) of the light transmission spectrum is wide and the skirt of the light transmission spectrum is large.

Further, it is preferable that the FWHM of the light transmission spectrum of the coating film is wider than the FWHM of the emission spectrum of the light source but narrower than the FWHM of the emission spectrum of the phosphor layer.

In the case where the FWHM of the light transmission spectrum of the coating film is narrower than the FWHM of the emission spectrum of the light source, there is a possibility that most of the excitation light (primary light) emitted from the light source and the fluorescence (secondary light) generated in the phosphor layer are absorbed by the coating film.

In the case where the FWHM of the light transmission spectrum of the coating film is wider than the FWHM of the emission spectrum of the phosphor layer, light with various colors is transmitted through the coating film. As a result, the coating film is substantially colorless and transparent and therefore it is difficult to cause the coating film to be colored in a desired color.

<Third Aspect>

The third aspect of the present invention is the illumination device according to the first or second aspect, in which the excitation light of the light source is a blue light, the emitted light of the phosphor layer is a white light, and the pigment is a blue color.

In the third aspect, it is possible to realize an illumination device that is excellent in appearance and is shining in blue.

Further, in the third aspect, since the pigment of the coating film and the excitation light of the light source have the same blue color as each other, it is possible to make the emitted light of the illumination device closer to a single color.

In addition, since the secondary light (fluorescence) passes through the longer wavelength side of the peak of the light transmission spectrum of the coating film than the primary light (excitation light), the whole region of the peak of the light transmission spectrum can be effectively utilized. Accordingly, it is possible to achieve a bright illumination device by increasing the light intensity of the emitted light, as compared to a case where only the light source is provided and the phosphor layer is not provided.

<Fourth Aspect>

The fourth aspect of the present invention is the illumination device according to any one of the first, second and third aspects, in which the light source is an LED.

In the fourth aspect, it is possible to realize the illumination device of the first, second and third aspects at a low cost.

DETAILED DESCRIPTION OF THE INVENTION

Hereinafter, respective embodiments of the present invention will be described with reference to the drawings.

Meanwhile, in each drawing, in order to simplify the explanation, the size, shape and arrangement of the components of respective embodiments are schematically illustrated in an exaggerated manner. Therefore, the size, shape and arrangement of the components illustrated will not necessarily be the same as the actual.

First Embodiment

Figure 1:
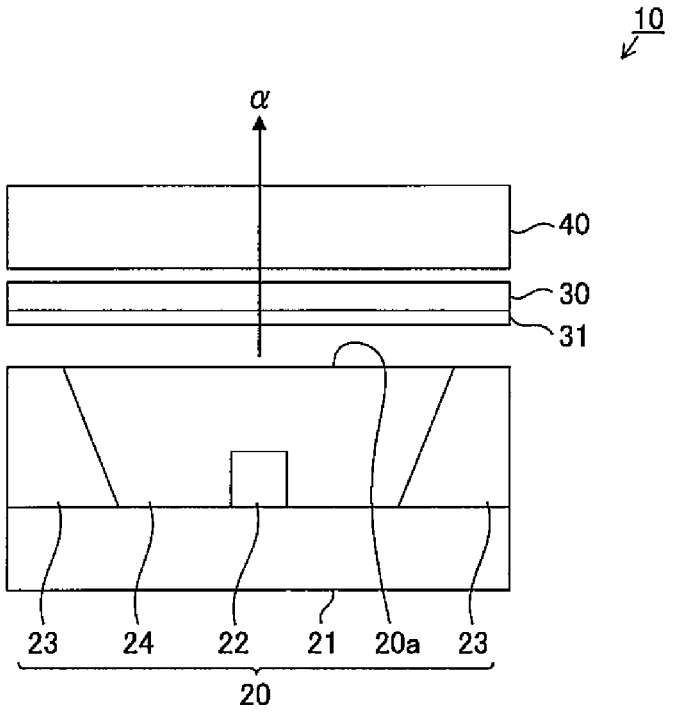
FIG. 1 is a longitudinal sectional view illustrating a schematic configuration of an illumination device 10 according to a first embodiment of the present invention.
Figure 2:
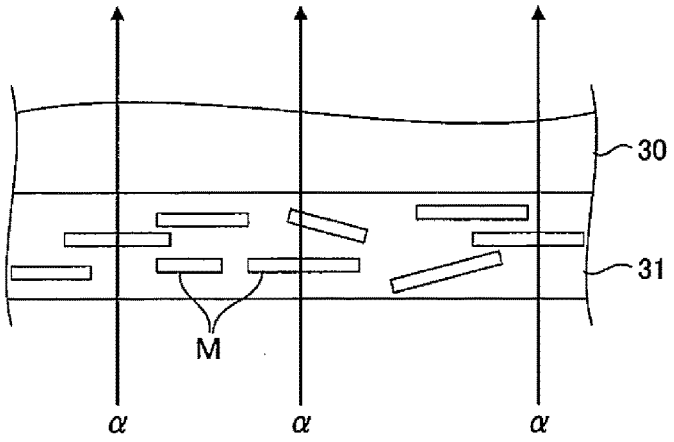
FIG. 2 is a longitudinal sectional view illustrating a schematic configuration of a sheet material 30 of the illumination device 10.
Figure 2:
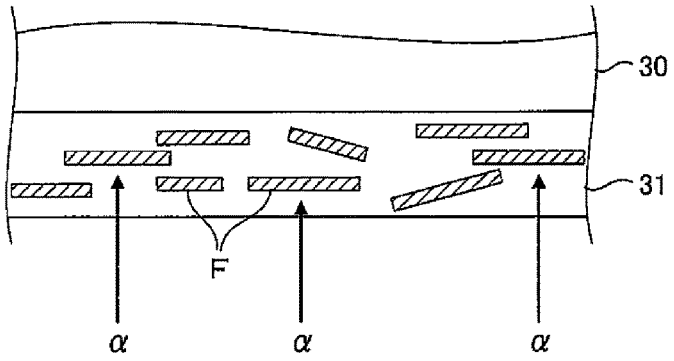

As illustrated in FIGS. 1 and 2, an illumination device 10 of a first embodiment contains a light source unit 20, a sheet material 30, a coating film 31, a lens 40 and the like. The illumination device 10 can be used as an ornament with illumination for a vehicle.

Incidentally, the ornament refers to general decorations such as emblems attached to a car or logos of car manufacturers.

The light source unit 20 includes a substrate 21, an LED (Light Emitting Diode) chip 22, a frame 23, a phosphor layer 24, a light emitting surface 20*a*, and the like.

The substrate 21 may have a flat shape and be formed by, for example, a substrate made of a bulk material of an insulating material (e.g., ceramics material such as aluminum nitride, synthetic resin material, etc.) or a substrate where an insulating layer is formed on a surface of a metallic material (e.g., aluminum alloy, pure copper, copper-based alloy, etc.).

The LED chip 22 may be a blue LED having a substantially rectangular parallelepiped shape.

A back surface side (lower surface side) of the LED chip 22 is fixedly attached to a wiring layer (not shown) formed on the surface of the substrate 21 by using a die bonding material.

The frame 23 may have a rectangular frame shape and be fixedly attached on the surface of the substrate 21 so as to surround the LED chip 22.

Incidentally, an inner wall surface of the frame 23 may have light reflectivity and be formed in an inclined surface shape that spreads toward an opening side of the frame 23.

Further, the frame 23 may be formed by a white synthetic resin material (e.g., silicone resin, epoxy resin, nylon resin, etc.) containing fine particles of material with high light reflectivity (e.g., titanium oxide, aluminum oxide, etc.); a light-reflective ceramics material (e.g., aluminum oxide, etc.); a light-reflective metallic material (e.g., aluminum alloy, etc.); or the like.

The phosphor layer (sealing layer) 24 may be filled in the frame 23 so as to cover the front surface (upper surface) and the side surface of the LED chip 22, thereby sealing the LED chip 22.

Further, the surface of the phosphor layer 24, which is exposed through the opening of the frame 23, may be formed in a flat shape, and the surface of the phosphor layer 24 may serve as the light emitting surface 20*a* of the light source unit 20.

Incidentally, the phosphor layer 24 may contain a phosphor and a transparent film-forming component (base material) in which the phosphor is contained and mixed.

Examples of the phosphor contained in the phosphor layer 24 include YAG (Yttrium Aluminum Garnet)-based phosphors, LuAG (Lutetium Aluminum Garnet)-based phosphors, TAG (Terbium Aluminum Garnet)-based phosphors, BOS (Barium Orthosilicate)-based phosphors, SiAlON-based phosphors, CASN ($CaAlSiN_3$)-based phosphors, etc.

Further, examples of the film-forming component of the phosphor layer 24 include a synthetic resin material (e.g., silicone resin, epoxy resin, etc.), a sol-gel glass, and the like.

The sheet material 30 may have a sheet shape formed by a transparent synthetic resin material (e.g., acrylic resin, etc.) and be disposed on the front side of the light emitting surface 20*a* of the light source unit 20.

The surface of the sheet material 30 may be subjected to various decorative processing (e.g., a coloring processing, a half-mirror processing, a pattern print processing, etc.).

The sheet material 30 may be provided at its back surface with the coating film (coating layer, paint layer) 31.

The coating film 31 is formed by applying a paint containing a coloring pigment, mica and a film-forming component (base material) in which the pigment and mica are contained and mixed.

As the pigment of the coating film 31, a blue pigment is mainly used.

Examples of the blue pigment include Victoria Blue B, Victoria Blue R, Victoria Pure Blue B, Benzimidazolone Dioxazine, Aluminum Phthalocyanine Blue, Cobalt Phthalocyanine Blue, Indigo Carmine Lake, Reflex Blue, Indanthrene Blue, Alkali Blue, Cobalt Aluminum Blue, Ultramarine Blue, Cobalt Blue, Prussian Blue, Brilliant Blue Lake, Metal-Free Phthalocyanine Blue, γ-Phthalocyanine Blue, β-Phthalocyanine Blue, and α-Phthalocyanine Blue, etc.

Among them, α-Phthalocyanine Blue is preferred since it has good weather resistance, heat resistance and solvent resistance and is inexpensive.

In addition to the blue pigment, for the purpose of finely adjusting color, Carbon Black, Quinacridone Red, titanium oxide, and the like may be used together.

The content ratio (blending ratio) of the pigment in the paint for forming the coating film 31 is suitably in the range of 0.1% to 15%, preferably 0.5% to 10%, and more preferably 1% to 6% in PWC.

Here, PWC (Pigment Weight Concentration) is calculated by the following formula.

$$PWC=\{\text{Contained pigment weight(g)}/\text{Total paint solid weight(g)}\}\times 100$$

When the content ratio of the blue pigment is greater than the above range, the light permeability of the coating film 31 is extremely low. Accordingly, the emitted light of the light source unit 20 is not transmitted through the coating film 31 even when the LED chip 22 is turned on, and as a result, it is not possible to allow the coating film 31 to be brightly emitted.

When the content ratio of the blue pigment is less than the above range, the light permeability of the coating film 31 is extremely high. Accordingly, an internal mechanism (light source unit 20, etc.) of the illumination device 10 is seen through the coating film 31, and as a result, the design quality of the illumination device 10 is lowered.

As the mica of the coating film 31, untreated mica whose surface is not coated with another material or pearl mica which is surface-treated with metal oxides such as titanium oxide can be used.

In the case where the pearl mica is used as the mica of the coating film 31, white pearl or silver pearl where coverage of the titanium oxide is 1% to 43 is properly used. The coverage of the titanium oxide is more preferably 5% to 36%.

When the coverage of the titanium oxide is more than 43%, the reflected light or transmitted light is discolored due to the interference and therefore an object of the present invention is not satisfied. Further, this is not preferable since the light transmittance of the coating film 31 is lowered.

The mica of the coating film 31 has light permeability to the emitted light of the light source unit 20. The mica of the coating film 31 is preferably formed in a thin-plate shape or a scale-like shape having a thickness of 0.1 to 100 μm. Further, it is desirable that the surface of particles of the mica is smooth.

The particle size of the mica is suitably 1 to 1000 μm, preferably 2 to 200 μm, and more preferably 5 to 50 μm.

When the particle size of the mica is greater than the above range, the graininess of the mica is conspicuous and ends of the particles of the mica protrude from the surface of the coating film 31. Accordingly, the design quality of the coating film 31 is lowered.

When the particle size of the mica is less than the above range, the brilliance of the coating film 31 is insufficient. Accordingly, the coating film 31 cannot express a metallic tone and the design quality is thus lowered.

The content ratio of the mica in the paint for forming the coating film 31 is suitably in the range of 0.5% to 45%, preferably 1% to 20%, and more preferably 2% to 10% in PWC.

When the content ratio of the mica is greater than the above range, the brilliance of the coating film 31 is too strong and the design quality is thus lowered. Further, the proportion of the film-forming component of the coating film 31 is too small and therefore the coating film 31 is less likely to be held. Specifically, since it is difficult to meet requirements of various performances such as durability of the coating film 31, the mica is separated from the coating film 31.

Further, when the content ratio of the mica is greater than the above range, the cost of the illumination device 10 is also increased because the mica is expensive.

When the content ratio of the mica is less than the above range, the brilliance of the coating film 31 is insufficient. Accordingly, the coating film 31 cannot express a metallic tone and the design quality is thus lowered.

Examples of the synthetic resin used as the film-forming component of the coating film 31 include an acrylic resin, a melamine resin, an alkyd resin, an epoxy resin, a polyurethane resin, a polyester resin, a polystyrene resin, a polypropylene resin, an acrylic melamine resin, an acrylic urethane resin, an acrylic silicone resin, etc.

The lens 40 may have a flat shape and be formed by a transparent synthetic resin material (e.g., acrylic resin, etc.). The lens 40 may be disposed on the front side (on the side opposite to the light source unit 20) of the sheet material 30.

Function and Effect of First Embodiment

According to the illumination device 10 of the first embodiment, the following function and effect can be achieved.

[1] The illumination device 10 contains the LED chip 22 (light source) configured to emit excitation light, the phosphor layer 24 containing a phosphor and configured to allow the excitation light of the LED chip 22 to be transmitted and emitted therethrough, and the coating film 31 formed by applying a paint containing a pigment and mica and configured to allow the emitted light of the phosphor layer 24 to be transmitted and emitted therethrough.

In the illumination device 10, a secondary light (fluorescence) is generated in such a manner that a portion of a primary light which is the excitation light emitted from the LED chip 22 excites the phosphor contained in the phosphor layer 24 to generate a wavelength-converted secondary light (fluorescence). The primary light and the secondary light are mixed, so that the mixed light is emitted as the emitted light from the phosphor layer 24, as indicated by an arrow α in FIG. 1.

FIG. 2(A) is a longitudinal sectional view illustrating a schematic configuration of the sheet material 30 of the illumination device 10. In FIG. 2(A), a state of mica M contained in the coating film 31 is schematically illustrated.

As indicated by an arrow α in FIG. 2(A), since the light emitted from the phosphor layer 24 (not shown in FIG. 2(A)) is transmitted through the mica M, the light permeability of the coating film 31 for the light emitted from the phosphor layer 24 is high.

That is, since the coating film 31 contains the mica M, the coating film 31 has characteristics of preferentially developing light permeability for excitation light in the turn-on time (emitting time) of the LED chip 22 and preferentially developing light reflectivity for external light in the turn-off time (non-emitting time) of the LED chip 22.

FIG. 2(B) is a schematic view illustrating a state of metallic flakes F contained in the coating film 31 in the case where the coating film 31 is a metallic coating film.

As indicated by an arrow α in FIG. 2(B), since the light emitted from the phosphor layer 24 (not shown in FIG. 2(B)) is blocked by the metallic flakes F, the light permeability of the coating film 31 is low.

Figure 3:
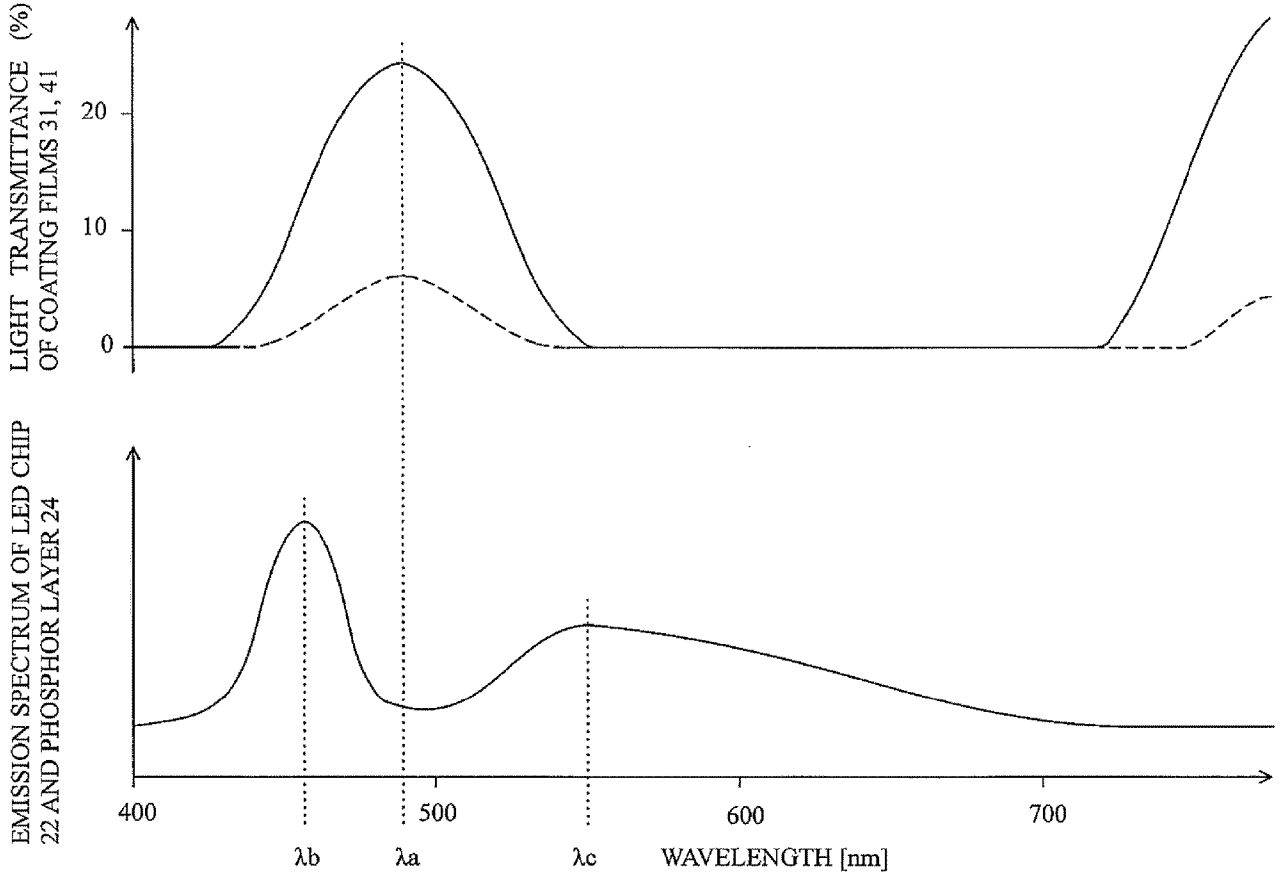
FIG. 3 is a characteristic view for explaining the function and effect of the illumination device 10.

FIG. 3 is a characteristic view illustrating an example of a relationship between the light transmission spectrum of the coating film 31, and the emission spectrum of the LED chip 22 and the emission spectrum of the phosphor layer 24. The solid line of the upper spectrum of FIG. 3 indicates the light transmittance of coating film containing mica, and the dotted line of the upper spectrum of FIG. 3 indicates the light transmittance of metallic coating film.

Meanwhile, the light transmission spectrum refers to the distribution of light transmittance to the wavelength of light, and the emission spectrum refers to the distribution of emission intensity to the wavelength of light.

As illustrated in FIG. 3, the light transmittance of the coating film 31 containing the mica can be increased by 20% or more, as compared to a metallic coating film 31.

Further, a peak wavelength λa of the light transmittance of the coating film 31 is located between a peak wavelength λb of the emission spectrum of the LED chip 22 and a peak wavelength λc of the emission spectrum of the phosphor layer 24.

Therefore, when the LED chip 22 is turned on, the emitted light (excitation light plus fluorescence) of the light source unit 20 is absorbed and scattered by the pigment of the coating film 31 and also transmitted through the mica of the coating film 31, so that the emitted light is uniformly diffused. Accordingly, it is possible not only to allow the coating film 31 to be glittered with high brightness but also to reduce the emission unevenness of the coating film 31.

Further, when the LED chip 22 is turned off, it is possible to allow the coating film 31 to be glittered in a metallic tone (to provide a metallic feeling to an appearance) by increasing the brilliance of the coating film 31.

As a result, according to the first embodiment, it is possible to provide the illumination device 10 capable of improving the design quality in both the turn-on time and the turn-off time of the LED chip 22.

[2] As illustrated in FIG. 3, since the strength in the light transmission spectrum of the coating film 31 smoothly varies centering around the peak wavelength, it is possible to more reliably achieve the function and effect of the [1].

Meanwhile, the smooth varying in the strength in the light transmission spectrum of the coating film 31 means that FWHM of the light transmission spectrum is wide and the skirt of the light transmission spectrum is large.

The case where the strength in the light transmission spectrum smoothly varies is preferably the case where (1) the shorter wavelength of the wavelengths at which the strength in the light transmission spectrum becomes a half value is shorter (a shorter wavelength) than the peak wavelength of the emission spectrum of the LED chip and (2) the longer wavelength of the wavelengths at which the strength in the light transmission spectrum becomes a half value is longer (a longer wavelength) than the shorter wavelength of the wavelengths at which the strength in the emission transmission spectrum of the phosphor layer becomes a half value. In other words, it is preferred that the wavelength range of FWHM of the light transmission spectrum includes the peak wavelength of the emission spectrum of the LED chip and the shorter side wavelength of the FWHM of the emission spectrum of the phosphor layer.

In the case where the shorter wavelength of the wavelengths at which the strength in the light transmission spectrum becomes a half value is longer than the peak wavelength of the emission spectrum of the LED chip, light (primary light) emitted from the LED chip, which has a narrow FWHM, cannot be transmitted sufficiently in some cases. In the case where the longer wavelength of the wavelengths at which the strength in the light transmission spectrum becomes a half value is shorter than the shorter side wavelength of the FWHM of the emission spectrum of the phosphor layer, light (secondary light) emitted from the phosphor layer cannot be transmitted sufficiently in some cases.

Further, it is more preferred that (3) the longer wavelength of the wavelengths at which the strength in the light transmission spectrum becomes a half value is shorter than the peak wavelength of the emission spectrum of the phosphor layer.

In the case where the longer wavelength of the wavelengths at which the strength in the light transmission spectrum becomes a half value is longer than the peak wavelength of the emission spectrum of the phosphor layer, the FWHM of the light transmission spectrum of the coating film is extremely wide, various light having various wavelength is transmitted through the coating film and the color of the coating film varies, in some cases as described below.

Further, it is preferable that the FWHM of the light transmission spectrum of the coating film 31 is wider than the FWHM of the emission spectrum of the LED chip 22 but narrower than the FWHM of the emission spectrum of the phosphor layer 24.

In the case where the FWHM of the light transmission spectrum of the coating film 31 is narrower than the FWHM of the emission spectrum of the LED chip 22, there is a possibility that most of the excitation light (primary light) emitted from the LED chip 22 and the fluorescence (secondary light) generated in the phosphor layer 24 are absorbed by the coating film 31.

In the case where the FWHM of the light transmission spectrum of the coating film 31 is wider than the FWHM of the emission spectrum of the phosphor layer 24, light with various colors is transmitted through the coating film 31. As a result, the coating film 31 is substantially colorless and transparent and therefore it is difficult to cause the coating film 31 to be colored in blue.

[3] In the illumination device 10, a secondary light (yellow light; wavelength of from about 580 nm to 595 nm) is generated in such a manner that a portion of a primary light (blue light; wavelength of from about 435 nm to 480 nm) which is an excitation light emitted from the LED chip 22 excites the phosphor contained in the phosphor layer 24 to generate a wavelength-converted secondary light. The primary light and the secondary light are mixed to create a white light, so that the white light is emitted as the emitted light from the phosphor layer 24.

Further, the pigment contained in the coating film 31 is blue and the white light emitted from the phosphor layer 24 is emitted as a blue light from the illumination device 10. Accordingly, it is possible to achieve the illumination device 10 that is excellent in appearance and is shining in blue.

Furthermore, since the pigment of the coating film 31 and the primary light (excitation light) of the LED chip 22 have the same blue color as each other, it is possible to make the emitted light of the illumination device 10 closer to a single color.

In addition, the secondary light (fluorescence) passes through the longer wavelength side of the peak of the light transmission spectrum of the coating film 31 than the primary light (excitation light), so that the whole region of the peak of the light transmission spectrum can be effectively utilized. Accordingly, it is possible to achieve a bright illumination device 10 by increasing the light intensity of the emitted light, as compared to a case where only the LED chip 22 is provided and the phosphor layer 24 is not provided.

[4] In the illumination device 10, since the LED chip 22 is used as the excitation light source, it is possible to reduce the cost.

Second Embodiment

Figure 4:
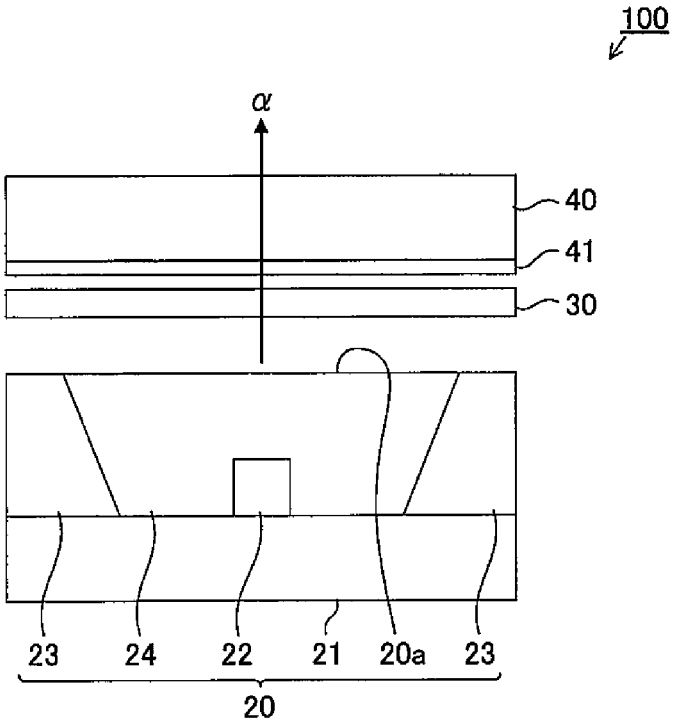
FIG. 4 is a longitudinal sectional view illustrating a schematic configuration of an illumination device 100 according to a second embodiment of the present invention.

As illustrated in FIG. 4, an illumination device 100 of a second embodiment contains the light source unit 20, the sheet material 30, the lens 40, a coating film 41 and the like. The illumination device 100 can be used as an ornament with illumination for a vehicle.

The illumination device 100 of the second embodiment is different from the illumination device 10 of the first embodiment in that the coating film 41 is applied and formed on the back surface of the lens 40, instead of applying and forming the coating film 31 on the back surface of the sheet material 30. Here, the composition of the coating film 41 is the same as that of the coating film 31.

Accordingly, according to the second embodiment, it is possible to obtain substantially the same the function and effect as the first embodiment.

Another Embodiment

The present invention is not limited to each of the above-described embodiments but may be embodied as follows. Also in these cases, it is possible to obtain the function and effect equal to or better than each of the above-described embodiments.

[A] The LED chip 22 may be replaced with any excitation light source (e.g., an organic EL chip, etc.), as long as the excitation of the phosphor of the phosphor layer 24 can be made.

[B] In the first embodiment, the coating film 31 is applied and formed on the back surface of the sheet material 30. However, the coating film 31 may be applied and formed on the front surface of the sheet material 30.

Further, in the second embodiment, the coating film 41 is applied and formed on the back surface of the lens 40. However, the coating film 41 may be applied and formed on the front surface of the lens 40.

The present invention is not limited to the description of respective embodiments and each of the aspects. The present invention also includes various modifications which can be easily conceived by those skilled in the art without departing from the description of the claims. The contents of publications mentioned in the present specification are incorporated by reference in its entity.

The present application is based on the Japanese Patent Application No. 2013-231649 filed on Nov. 8, 2013, and the entire contents thereof are incorporated herein by reference.

DESCRIPTION OF REFERENCE NUMERALS AND SIGNS

10, 100 Illumination device
20 Light source unit
21 Substrate
22 LED chip (light source)
23 Frame
24 Phosphor layer
20*a* Light emitting surface

30 Sheet material
40 Lens
31, 41 Coating film

What is claimed is:

1. An illumination device comprising:

a light source configured to emit an excitation light;

a phosphor layer containing a phosphor and configured to allow the excitation light of the light source to be transmitted and emitted therethrough; and a coating film that includes a mixture of a mica-less pigment and a mica configured to allow the emitted light of the phosphor layer to be transmitted and emitted therethrough at a light transmission spectrum based on the composition of the mixture, wherein the light transmission spectrum of the mixture has a peak transmittance at a wavelength located between a peak wavelength of an emission spectrum of the light source and a peak wavelength of an emission spectrum of the phosphor layer.

2. The illumination device according to claim 1, wherein the light transmission spectrum of the coating film has strength smoothly varying centering around the peak wavelength.

3. The illumination device according to claim 1, wherein the excitation light of the light source is a blue light, the emitted light of the phosphor layer is a white light, and the mica-less pigment is a blue color.

4. The illumination device according to claim 1, wherein the light source is an LED.

5. The illumination device according to claim 1, further comprising a content ratio of the mica-less pigment in the coating film is about 0.1% to 15%, and a content ratio of the mica in the coating film is about 0.5% to 45%.

6. The illumination device according to claim 1, wherein the mica has a particle size range of about 1 to 1000 μm.

7. The illumination device according to claim 1, wherein the emission spectrum of the light source has a full width at half maximum, the emission spectrum of the phosphor layer has a full width at half maximum, and the light transmission spectrum of the coating film has a full width at half maximum that is wider than the full width at half maximum of the light source and that is narrower than the full width at half maximum of the phosphor layer.

8. The illumination device according to claim 1, wherein the mica is formed in a thin-plate shape or a scale shape and dispersed throughout the mica-less pigment in the mixture of the coating film.

9. The illumination device according to claim 1, wherein the mica-less pigment scatters and absorbs emitted light from the phosphor layer and the light source, and the mica transmits the emitted light from the phosphor layer and the light source.

10. The illumination device according to claim 1, wherein the pigment is at least one pigment selected from the group consisting of Victoria Blue B, Victoria Blue R, Victoria Pure Blue B, Benzimidazolone Dioxazine, Aluminum Phthalocyanine Blue, Cobalt Phthalocyanine Blue, Indigo Carmine Lake, Reflex Blue, Indanthrene Blue, Alkali Blue, Cobalt Aluminum Blue, Ultramarine Blue, Cobalt Blue, Prussian Blue, Brilliant Blue Lake, Metal-Free Phthalocyanine Blue, γ-Phthalocyanine Blue, β-Phthalocyanine Blue, and α-Phthalocyanine Blue.

11. The illumination device according to claim 1, wherein the coating film that includes the mixture of the mica-less pigment and the mica is disposed on, or above, the phosphor layer that contains the phosphor, the coating film being different from the phosphor layer.

12. The illumination device according to claim 1, wherein the coating film that includes the mixture of the mica-less pigment and the mica is disposed on, and different from, the phosphor layer that contains the phosphor.

13. The illumination device according to claim 1, wherein the phosphor layer has a light emitting surface, and the coating film that includes the mixture of the mica-less pigment and the mica is disposed on the light emitting surface of the phosphor layer.

14. The illumination device according to claim 1, wherein the phosphor layer has a light emitting surface, a sheet material has a first surface disposed on the light emitting surface and a second surface opposite to the first surface, and the coating film that includes the mixture of the mica-less pigment and the mica is disposed on the second surface of the sheet material.

15. The illumination device according to claim 1, further comprising a substrate that includes an upper surface that is attached to a bottom of the light source, wherein the phosphor layer is disposed on the upper surface of the substrate, surrounds the light source, and includes a light emitting surface, and the coating film that includes the mixture of the mica-less pigment and the mica is disposed above, or on, the light emitting surface of the phosphor layer.

* * * * *